US006446302B1

(12) United States Patent
Kasper et al.

(10) Patent No.: US 6,446,302 B1
(45) Date of Patent: Sep. 10, 2002

(54) EXTRACTION CLEANING MACHINE WITH CLEANING CONTROL

(75) Inventors: Gary A. Kasper, Grand Rapids; Samuel N. Hansen, Hudsonville; Jonathan L. Miner, Rockford; David E. McDowell, Grand Rapids, all of MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 0 days.

(21) Appl. No.: 09/593,126

(22) Filed: Jun. 13, 2000

Related U.S. Application Data

(60) Provisional application No. 60/139,127, filed on Jun. 14, 1999.

(51) Int. Cl.[7] ..... A47L 11/30

(52) U.S. Cl. ..... 15/319; 15/339; 15/320; 15/340.3; 15/389

(58) Field of Search ..... 15/319, 339, 320, 15/340.2, 383, 389, 340.3

(56) References Cited

U.S. PATENT DOCUMENTS

| | | | | | |
|---|---|---|---|---|---|
| 3,952,361 | A | * | 4/1976 | Wilkins | 15/319 |
| 5,237,720 | A | | 8/1993 | Blase et al. | 15/321 |
| 5,323,483 | A | * | 6/1994 | Baeg | 15/319 |
| 5,539,953 | A | | 7/1996 | Kurz | 15/367 |
| 5,608,944 | A | * | 3/1997 | Gordon | 15/319 |
| 5,613,261 | A | * | 3/1997 | Kawakami et al. | 15/319 |
| 5,815,884 | A | * | 10/1998 | Imamura et al. | 15/320 |
| 5,839,156 | A | | 11/1998 | Park et al. | 15/339 |
| 5,841,259 | A | | 11/1998 | Kim et al. | 15/323 |
| 5,867,861 | A | | 2/1999 | Kasen et al. | 15/320 |
| 5,937,475 | A | | 8/1999 | Kasen et al. | 15/320 |
| 5,987,696 | A | * | 11/1999 | Wang | 134/21 |
| 6,055,702 | A | | 5/2000 | Imamura et al. | 15/339 |
| 6,167,587 | B1 | * | 1/2001 | Kasper et al. | 15/320 |
| 6,176,940 | B1 | * | 1/2001 | Wang | 15/319 |

* cited by examiner

*Primary Examiner*—Theresa T. Snider
(74) *Attorney, Agent, or Firm*—McGarry Bair LLP

(57) ABSTRACT

The invention relates to an extraction cleaning machine including condition sensors for generating condition signals representative of a condition of the surface being cleaned, a controller, and variable-control cleaning systems, wherein the controller sends control signals to the variable-control cleaning systems in response to sensor signals received from the condition sensors. The invention further relates to a self-propelled extraction cleaning machine, and to an extraction cleaning machine including condition sensors and audible or visual indicators to notify the operator of the condition of the surface being cleaned.

41 Claims, 9 Drawing Sheets

EXTRACTION CLEANING MACHINE WITH CLEANING CONTROL

This application claims the benefit of U.S. Provisional Patent Application Ser. No. 60/139,127, filed Jun. 14, 1999.

BACKGROUND OF THE INVENTION

1. Field of the Invention

This invention relates to an extraction cleaning machine and, more particularly, to an upright extraction cleaning machine. In one of its aspects, the invention relates to a self-propelled extraction cleaning machine. In another of its aspects, the invention relates to a self-propelled extraction cleaning machine with dirt sensing. In another of its aspects, the invention relates to an extraction cleaning machine in which the degree of a cleaning function is controlled by the amount of dirt in the carpet.

2. Description of Related Art

Upright extraction cleaning machines have been used for removing dirt from surfaces such as carpeting, upholstery, drapes and the like. The known extraction cleaning machines can be in the form of a canister-type unit as disclosed in U.S. Pat. No. 5,237,720 or an upright unit as disclosed in U.S. Pat. No. 5,867,861.

Current upright extraction cleaning machines can be made easier to use by limiting the weight and number of components, such as fluid storage tanks, on the pivoting handle of the upright cleaning machine. Reducing the weight that a user must support as the handle is tilted rearwardly can also lower the center of gravity for the machine, which results in a better feel to the user. The degree of cleaning depends on a number of factors, including the speed of the machine along the surface to be cleaned, the relative amounts of cleaning solution and water, the amount of soil in the carpet or surface, the amount of suction applied to remove the dirty fluid from the carpet or other surface and the temperature of the cleaning fluid. The use of an agitator, if any, and the speed and pressure of the agitator will also affect the cleaning of the carpet. These factors are generally not controlled with respect to the carpet or floor condition although on some machines, the relative amounts of cleaning solution and water can be manually adjusted by the operator. However, the operator does not have any scientific way to judge the amount of soil in the carpet and simply does a visual guess as to the condition of the carpet and adjusts the amount of cleaning solution in the mix. Further, the speed of the extractor along the carpet or other surface depends on the operator. Thus, the rate of cleaning will likely vary by operator.

SUMMARY OF THE INVENTION

According to the invention, an extraction surface cleaning apparatus having a housing, at least two wheels mounted to the housing for supporting the housing for movement along a surface to be cleaned, a liquid dispensing system mounted to the housing, a fluid recovery system mounted to the housing, and a vacuum source. The liquid dispensing system includes a liquid dispensing nozzle for applying liquid to a surface to be cleaned, a fluid supply chamber for holding a supply of cleaning fluid, and a fluid supply conduit fluidly connected to the fluid supply chamber and to the dispensing nozzle for supplying fluid to the dispensing nozzle. The recovery system includes a recovery chamber for holding recovered fluid, a suction nozzle, and a working air conduit extending between the recovery chamber and the suction nozzle. The vacuum source is in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber. The apparatus further comprises a variable cleaning control element mounted on the housing and adjustable to control the rate of cleaning by the extraction surface cleaning apparatus, and a sensor for detecting a condition of the surface to the cleaned and for generating a condition signal representative of the detected condition of the surface to be cleaned.

In one embodiment, a controller is operably coupled to the sensor and to the variable cleaning control element. The controller is programmed to control the variable cleaning control element in accordance with the detected condition of the surface to be cleaned. The detected condition can be related to the degree of soil in the surface to be cleaned and the condition signal is a soil-degree signal. In one embodiment, the controller includes a data structure having data representative of various degrees of soil in the surface and control settings on the variable cleaning control element. The controller is programmed to compare the soil degree signal with the data representative of various degrees of soil in the surface to be cleaned (or being cleaned) and for generating a control signal to the variable cleaning control element to adjust the degree of cleaning of the extraction surface cleaning apparatus to match the detected degree of soil in the surface to be cleaned.

In one embodiment, the variable cleaning control element is a motor operably connected to the wheels for driving the wheels and powering the housing along the surface to be cleaned. In this embodiment, the variable cleaning control element is a speed control component for controlling the rotational speed of the wheels. In a further embodiment, the motor is a variable speed motor operably connected to the wheels for driving the wheels and powering the housing along the surface to be cleaned. The speed control component controls the speed of the motor and thus the rotational speed of the wheels and the speed of the extractor along the surface being cleaned.

In a further embodiment, the fluid supply chamber comprises a first tank for concentrated cleaning solution, a second tank for water, a mixing valve for adjusting the relative amounts of concentrated cleaning solution and water, and conduits between the first and second tanks and the mixing valve. In this embodiment, the variable cleaning control element is the mixing valve.

In a further embodiment, the sensor detects the soil degree condition by measuring a characteristic of the surface to be cleaned, or, in the alternative measures a property of the recovered fluid. The sensor can be positioned to detect the condition of the fluid in the working conduit, or in the recovery chamber. The property of the recovered fluid can include relative degree of dirt in the recovered fluid or the relative amounts of foam in the recovery chamber.

The sensor preferably comprises a photocell for detecting light level transmitted through or reflected by the surface or the fluid, and can include a light source. The sensor can also comprise a conductivity sensor.

In a further embodiment, the controller is operably coupled to the sensor and to the variable cleaning control element to control the variable cleaning control element in accordance with the detected condition of the surface to be cleaned. The the controller includes a data structure having data representative of various degrees of soil in the surface and control settings on the variable cleaning control element. The data structure includes data representative of the light intensity value of the cleaning fluid and the controller includes a spectral comparator for comparing the light intensity value of the recovered fluid to the light intensity value of the cleaning fluid. The light intensity value can be a predetermined value. Alternatively, a sensor on the housing detects the color of the cleaning fluid in the fluid supply conduit and generates a signal representative of the detected color which in turn forms the data representative of the light intensity value of the cleaning fluid.

The condition being detected by the sensor can further include a concentration of a chemical component of the recovered fluid. The component can be a compound in the cleaning fluid that is modified by the soil level in the recovered fluid.

In a further embodiment, the sensor comprises a reflectance sensor directed at the surface being cleaned to sense the degree of soil in the surface.

In a still further embodiment, the an indicator is mounted to the housing and coupled to the sensor to indicate to an operator the detected condition of the relative degree of soil in the surface to be cleaned.

In yet another embodiment, the controller is operably coupled to the sensor and to the variable cleaning control element, and the controller has a memory with a first stored reference value representative of a desired clean floor condition. The controller is further programmed to compare the soil degree signal with the first stored reference value and for applying a control signal to the variable cleaning control elements until the soil degree signal is within a predetermined threshold of the first stored reference value.

Further, the controller can include a learning mode, an active mode and a manual switch for converting the controller from the learning mode to the active mode and vice versa. The controller is programmed so that the soil degree signal is the first stored reference value when the controller is in the learning mode, and, when the controller is in the active mode, the soil degree signal is compared with the first reference value to control the variable cleaning control element in accordance with the detected condition of the surface to be cleaned. In this manner, a user can place the controller in the learning mode via the manual switch and operate the extractor over a clean floor surface to set the first reference value, and then manually switch to the active mode and operate the extraction surface cleaning apparatus on a dirty floor surface.

The sensor can further comprise a moisture sensor positioned to detect the level of moisture in the surface to be cleaned. The detected moisture sensor signal is used to control the level of extraction of the extractor, either manually or automatically by a controller.

In further embodiments, the apparatus further comprises an in-line heater in the fluid supply conduit for heating the cleaning fluid, and a variable electrical supply to the in-line heater, wherein the variable cleaning control element comprises the variable electrical supply.

In a further embodiment, the variable cleaning control element is a variable-flow fluid pump in the fluid supply conduit.

In a further embodiment, the variable cleaning control element is a variable-speed motor configured to vary the suction in the vacuum source.

In a further embodiment, an agitator for agitating the surface to be cleaned is mounted on the housing and a height-adjustment mechanism mounts the agitator to the housing at various heights with respect to the surface to be cleaned. The variable surface control element comprises the height-adjustment mechanism. In a further embodiment, the variable cleaning control element is a variable pressure application mechanism which is controlled to apply a variable degree of pressure to the agitator. In a further embodiment, the variable cleaning control element comprise a variable-speed motor for driving the agitator.

In a further embodiment, at least one booster tank is mounted on the housing for holding at least one of a booster and oxidizing agent, a mixing valve is connected to the at least one booster tank and to the cleaning solution tank for adjusting the relative amounts of booster or oxidizing agent and cleaning solution to the nozzles. The variable cleaning control element is the mixing valve in this embodiment.

In a still further embodiment, multiple variable cleaning control elements are mounted on the housing and are adjustable to control the degree of cleaning by the extractor. The controller is programmed to control each of the multiple variable cleaning control elements either singularly or multiply. The controller can have manual controls for at least some of the multiple cleaning control elements for manual selection or control of one or more of the cleaning control elements. The multiple cleaning control elements can include at least one of steam, solution concentration, speed along the surface to be cleaned, power to the vacuum source and pressure, height or speed of an agitator.

In a further embodiment, an audible or visual indicator is coupled to the sensor and adapted to indicate the relative degree of soil in the surface to be cleaned to an operator. A manual control is mounted on the housing for varying the cleaning control element by the operator in response to the indicator signal.

In a further embodiment, a sensor detects a condition relative to the degree of cleaning by the extraction surface cleaning apparatus; and an audible or visual indicator coupled to the sensor and adapted to indicate the condition relative to the selected degree of cleaning by the extraction surface cleaning apparatus. In one embodiment, the condition relative to the degree of cleaning is the speed of the extractor over the surface to be cleaned. In an alternative embodiment, the condition relative to the degree of cleaning is a property of the recovered fluid.

In a further embodiment, a sensor detects a condition relative to the level of moisture in the surface being cleaned and is adapted to generate a moisture level signal representative of the detected condition of the relative degree of moisture in the surface being cleaned. An audible or visual indicator is coupled to the sensor and adapted to indicate the relative moisture level in the surface being cleaned. A manual control is connected to the variable cleaning control element for varying the cleaning control element by the operator.

In yet another embodiment, a detector senses the speed of the housing across the surface being cleaned and generate a speed signal representative. An output device is mounted on the housing and is coupled to the detector for displaying or audibly expressing the relative speed of the housing across the floor being cleaned. For example, the detector could be a magnetic sensor on the wheels to detect the rotational speed of the wheels and the output device could be a speedometer with an analog output and which has a graphic relating the speed of the extractor to the degree of cleanability of the extractor so that the operator can adjust the speed of the extractor to the condition of the carpet or other surface being cleaned.

BRIEF DESCRIPTION OF THE DRAWINGS

The invention will now be described with reference to the drawings wherein.

DESCRIPTION OF THE PREFERRED EMBODIMENTS

Figure 1:
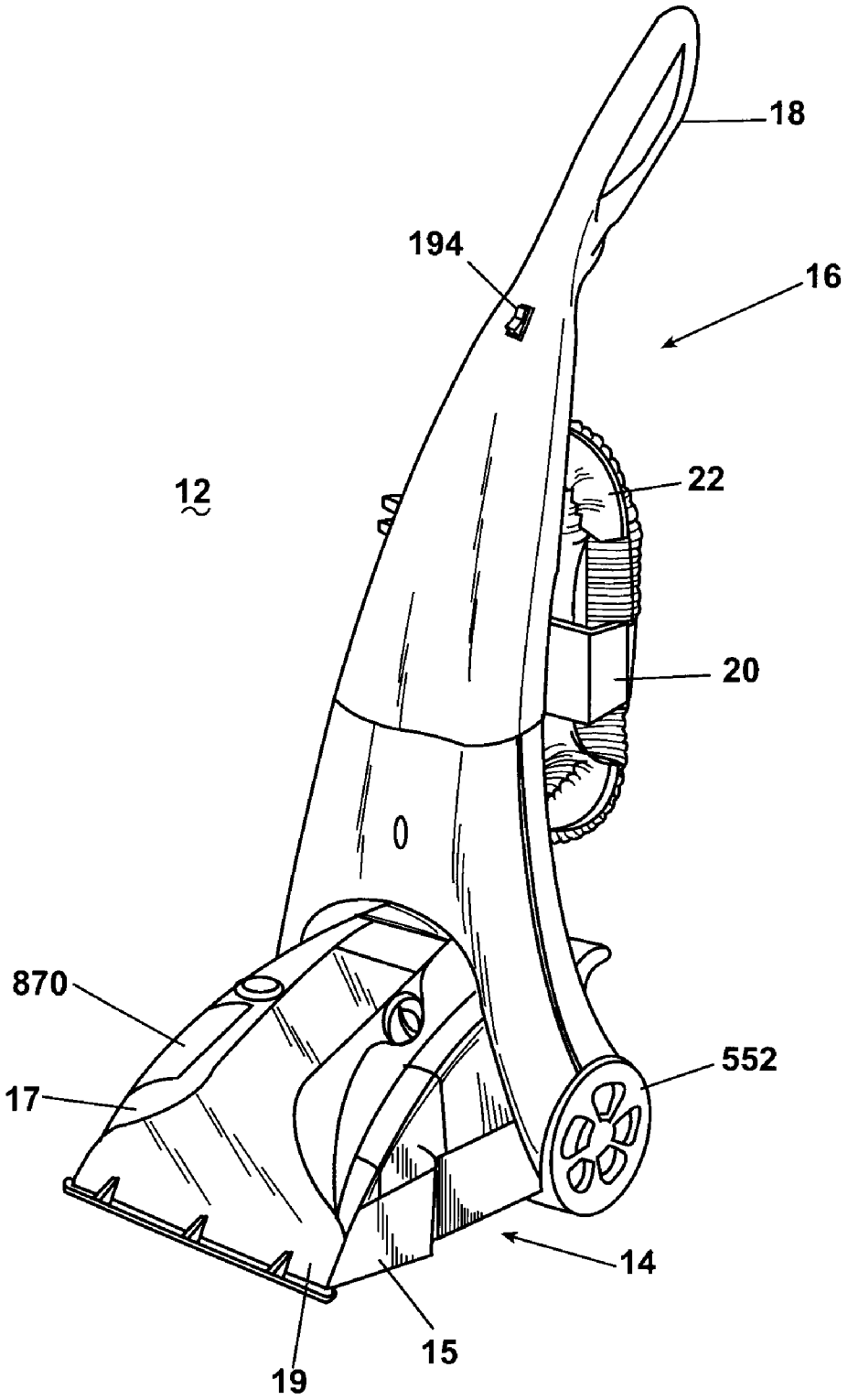
FIG. 1 is a perspective view of the extraction cleaning machine according to the invention.

The extraction cleaning machine according to the invention can be of the type disclosed in U.S. patent application Ser. No. 09/112,527, filed Jul. 8, 1998, now U.S. Pat. No. 6,167,587, issued Jan. 2, 2001 or U.S. Pat. No. 5,937,475, issued Aug. 17, 1999, both of which are incorporated herein by reference.

With reference to all the drawings, the base module 14 includes a lower housing portion 15 and an upper housing portion 17, which together define an interior for housing components and a well 36 for receiving a tank assembly 50. Further, a well (not shown) in the upper housing portion 17 receives a detergent supply tank 870. The upper housing portion 17 receives a transparent facing 19 for defining a first working air conduit 704 and a suction nozzle 34, which is disposed at a front portion of the base module 14 adjacent the surface being cleaned for recovering fluid therefrom. A vacuum source (not shown) is mounted on the base module 14 for drawing air and soiled water through the suction nozzle 34, through the working air conduit 704 and into a recovery chamber 48 in the tank assembly 50 in which the air is separated from the soiled water in the manner disclosed in the aforementioned U.S. patent application Ser. No. 09/112,527, now U.S. Pat. No. 6,167,587, issued Jan. 2, 2001 or the U.S. Pat. No. 5,937,475. The air is then exhausted from the base module in conventional fashion. The handle assembly 16 has a closed loop grip 18 provided at the uppermost portion thereof and a combination hose and cord wrap 20 that is adapted to support an accessory hose 22 and a electrical cord (not shown) when either is not in use. A conventional latch assembly (not shown) is mounted to the rear portion of the base module 14 adjacent the rotational union of the handle assembly 16 therewith for releasably locking the handle assembly 16 in its upright position.

The extraction cleaning machine 12 is powered in a forward direction by a motor 196 which is controlled by a main power switch 194 disposed on the handle assembly 16. Further, a heater 54 (FIG. 5) is mounted in the handle assembly 16 or base module 14 in the cleaning fluid supply line to heat the cleaning fluid and can be separately controlled by a heater power switch when the main power switch is in the "on" position. The user then supplies pressurized cleaning solution to the surface to be cleaned by depressing a trigger in the closed loop grip 18, whereupon solution flows to and through the fluid dispensing nozzles 100. As the user applies cleaning fluid and agitates the surface being cleaned with the brush, the cleaning machine 12 is typically driven forward and can also be driven rearwardly with a reversing motor, with the forward strokes being defined as wet cycles and the rearward strokes being defined as recovery cycles. During the wet cycles, the cleaning solution is applied to the surface via the fluid dispensing nozzles 100 and the agitation brush scrubs the subjacent surface. During the recovery cycles, the suction nozzle 34 removes applied solution, as well as dirt and debris, from the surface being cleaned and carries it to the recovery chamber 48 via the working air conduit 704. The extraction cleaning machine 12 can also be operated with the vacuum source activated throughout operation, so that applied solution, dirt, or other fluids on the surface being cleaned are removed by the suction nozzle 34 throughout the cleaning cycle. Further, the extraction cleaning machine 12 can be operated with the vacuum source deactivated for a period, allowing the operator to apply solution to the surface through fluid dispensing nozzles 100 for a pre-treat/soak period, with or without agitation, after which the vacuum source can be activated for removal of the applied solution from the surface.

Preferably, a conventional rotatably mounted agitation brush 206 is to provided near the front of the base module 14 and driven in the manner disclosed in the aforementioned U.S. patent application Ser. No. 09/112,527, now U.S. Pat. No. 6,167,587, issued Jan. 2, 2001 or the U.S. Pat. No. 5,937,475. Most preferably, the agitation brush is adapted for floor-responsive adjustment by a floating brush assembly mounted to a bottom portion of the base module 14. The floating movement of the agitation brush maintains continuous contact between the agitation brush and the surface being cleaned.

Figure 5:
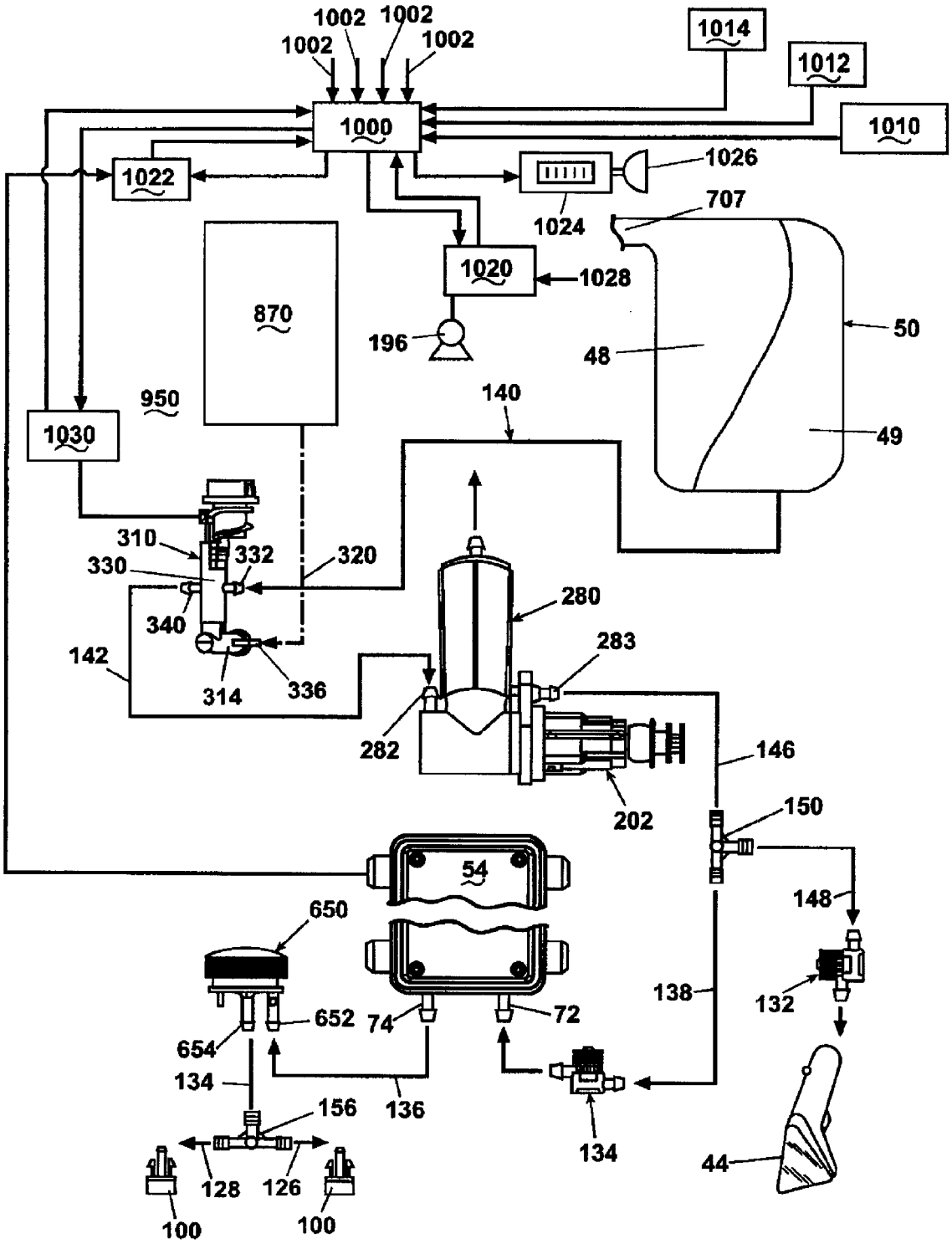
FIG. 5 is a schematic view of the fluid application system of the extraction cleaning machine according to one embodiment of the invention.

As shown best in FIG. 5, the fluid application system 950 conducts fluid from tank assembly 50 and detergent supply tank 870 to fluid dispensing nozzles 100, which are mounted in a forward portion of the base module 14. The fluid application system 950 preferably also supplies accessory cleaning tool 44, which also has a fluid-dispensing nozzle (not shown). Clean water flows from fluid supply chamber 49 of tank assembly 50, through conduit 140 and inlet 332 of the mixing valve assembly 310, which also includes a detergent inlet 336 that is fluidly connected to a detergent supply tank 870 by a conduit 320. Mixed detergent and clean water form a solution that exits the mixing valve assembly 310 via an outlet 340, which is fluidly connected by a conduit 142 to a pump priming system 280 disposed adjacent the pump 202. An inlet port 282 for the pump priming system 280 is connected to the conduit 142, and pressurized fluid is expelled from the pump 202 through a pump outlet port 283, which is fluidly connected via a conduit 146 to a T-connector 150. The T-connector 150 supplies pressurized fluid to both the accessory cleaning tool 44 and the heater 54 via conduits 148, 138, respectively. The conduit 148 includes a grip valve 132 by which the user can manually displace a valve member, thereby enabling the flow of non-heated, pressurized fluid to the spray tip on the accessory tool.

The conduit 138 includes a trigger valve 134 having a displaceable valve member actuable by a trigger assembly (not shown) for selectively supplying an in-line heater 54 with pressurized cleaning solution. Heated while passing through the heater 54, the fluid exits the in-line heater 54 via an outlet port 74, which is fluidly connected via a conduit 136 to an inlet 652 for a flow indicator 650. An outlet 654 for the flow indicator is fluidly connected to a T-connector 156 via a conduit 134. The T-connector 156 supplies fluid dispensing nozzles 100 with heated cleaning solution via conduits 126, 128.

The mixing valve assembly 310 is positioned intermediate the tank assembly 50 and the solution pump 202. Preferably, the mixing valve 310, a variable mixing valve to accommodate differing mixtures of detergent and clean water, is controlled by the valve controller 1030, which receives signals from the controller 1000 in response to dirt level measurements taken by the dirt sensor 1010. The variable mixing valve 310 comprises a valve body 330 having clean water inlet 332 that is fluidly connected to the tank assembly 50 and detergent inlet 336 that is fluidly connected to detergent supply tank 870 via the conduit 320 and the L-shaped fitting 314. A mixed solution outlet 340 is also formed on the valve body 330 and is adapted to conduct the clean water and detergent mixture, i.e., the cleaning solution, from the mixing valve 310 to a fluidly connected pump priming system 280 adjacent the inlet of the pump 202. With reference to FIGS. 2–5, the extraction cleaner 10 includes a controller 1000. Controller 1000 is electrically connected to a speed controller 1020 for a motor 196. Motor 196 drives rear wheels 552, such as through a drive belt 208. Controller 1000 is also electrically connected to valve controller 1030 for mixing valve 310. Mixing valve 310 receives a detergent from detergent supply tank 870 and clean water from tank assembly 50, and mixes the detergent with the water in a ratio according to the setting of the valve controller 1030 as directed by controller 1000. Controller 1000 is further electrically connected to at least one dirt sensor 1010, for receiving a signal from the sensor 1010 indicating a soil level in the surface being cleaned.

The controller 1000 is programmed to act on incoming signals and apply control signals, if appropriate, to a variable cleaning control element. The controller 1000 can be a simple hardwired circuit which applies a control signal to the variable cleaning control element in a linear response to the input dirt sensor signal. Alternatively, the controller 1000 can be a hardwired circuit or processor which is programmed to output a signal to the variable cleaning control element which is some function of the input signal from the dirt sensor. Alternatively, the controller 1000 can be a more complex computer controlled device which has a data structure with data representative of the relative degree of dirt in a carpet or on a floor, and output signals which correspond to control settings for one or more variable cleaning control elements in response to a variety of input signals representative of dirt in the carpet, dirt in the extracted water, level of moisture in the carpet, the type and shade of carpet or floor surface. The controller can have a programming function to learn a standard for each carpet or other surface that it cleans. The operational signals can be compared to the standard carpet data learned by the computer and adjustments can then be made accordingly to the variable cleaning control element or elements. In any case, the controller 1000 acts on the incoming signal to output a control signal, if appropriate, to the variable cleaning control element or elements. In the embodiment shown in FIG. 2, for example, the central processing unit can compare the signal received from the dirt sensor 1010 with a data structure in a memory having data representative of various degrees of soil in the surface to be cleaned, and generates control signals for adjusting the speed of motor 196, or the mixture of solution in mixing valve 310, or both, to match the detected degree of soil in the surface being cleaned. The controller 1000 applies the control signals to the valve controller 1030 and/or to the speed controller 1020 according to selected operating instructions and responsive to the input signal received from the dirt sensor 1010. The valve controller 1030 preferably includes a solenoid (not shown) or other electrically operated valve for mechanically adjusting the mixing valve 310. The speed controller 1020 preferably varies the power to the motor in a forward direction, thereby varying the speed of the wheels 552. A standard feedback loop is provided from the speed controller 1020 to the controller 1000 to determine when the speed of the motor reaches the desired speed. The controller 1000 is programmed to compare the feedback signal from the speed controller 1020 with the control signal and continues to apply the control signal to the speed controller 1020 until the motor reaches the desired speed. Likewise, a feedback loop is provided between the valve controller 1030 and the controller 1000 to when the valve reaches the desired degree of adjustment. The controller 1000 is programmed to compare the feedback signal from the valve controller 1030 with the control signal and to continue to apply the control signal to the valve controller 1030 until the valve actuator reaches the desired location.

Figure 2:
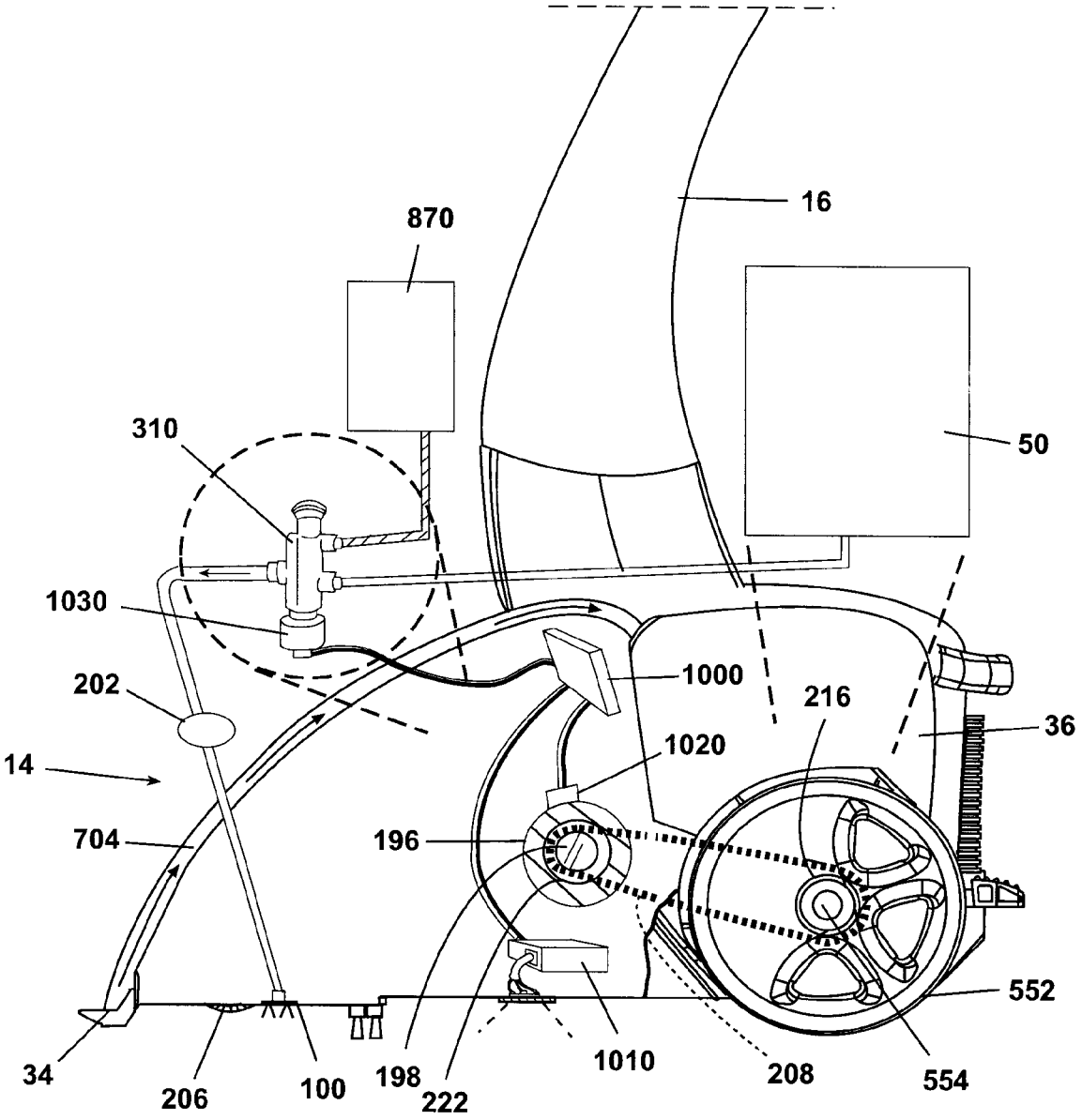
FIG. 2 is a diagrammatic side section view of a base module of the extraction cleaning machine shown in FIG. 1.

Dirt sensor 1010, as shown in FIG. 2, is a reflectometer directed at the surface to be cleaned, for measuring the reflectivity of the surface to be cleaned. The dirt sensor 1010 preferably includes a light source for transmitting radiation onto the surface being cleaned, and a detector for receiving radiation diffusely reflected by the surface. The light source can be a tungsten-halogen lamp and the detector can be a series of photoconductive cells, such as lead sulfide cells. The detector generates signals indicative of the characteristics of the surface being cleaned. Each cell generates an output signal indicative of the intensity of the reflected radiation within the respective frequency band unique to that cell. In a sensing system in which a sensor reads the surface directly, the data structure will preferably include reflectance reference data gathered from taking a control reading on a clean carpet segment. The processor compares the reflection characteristics of the surface to the reference data to identify the level of dirt present on the surface being cleaned, regardless of the base color of that surface.

Figure 3:
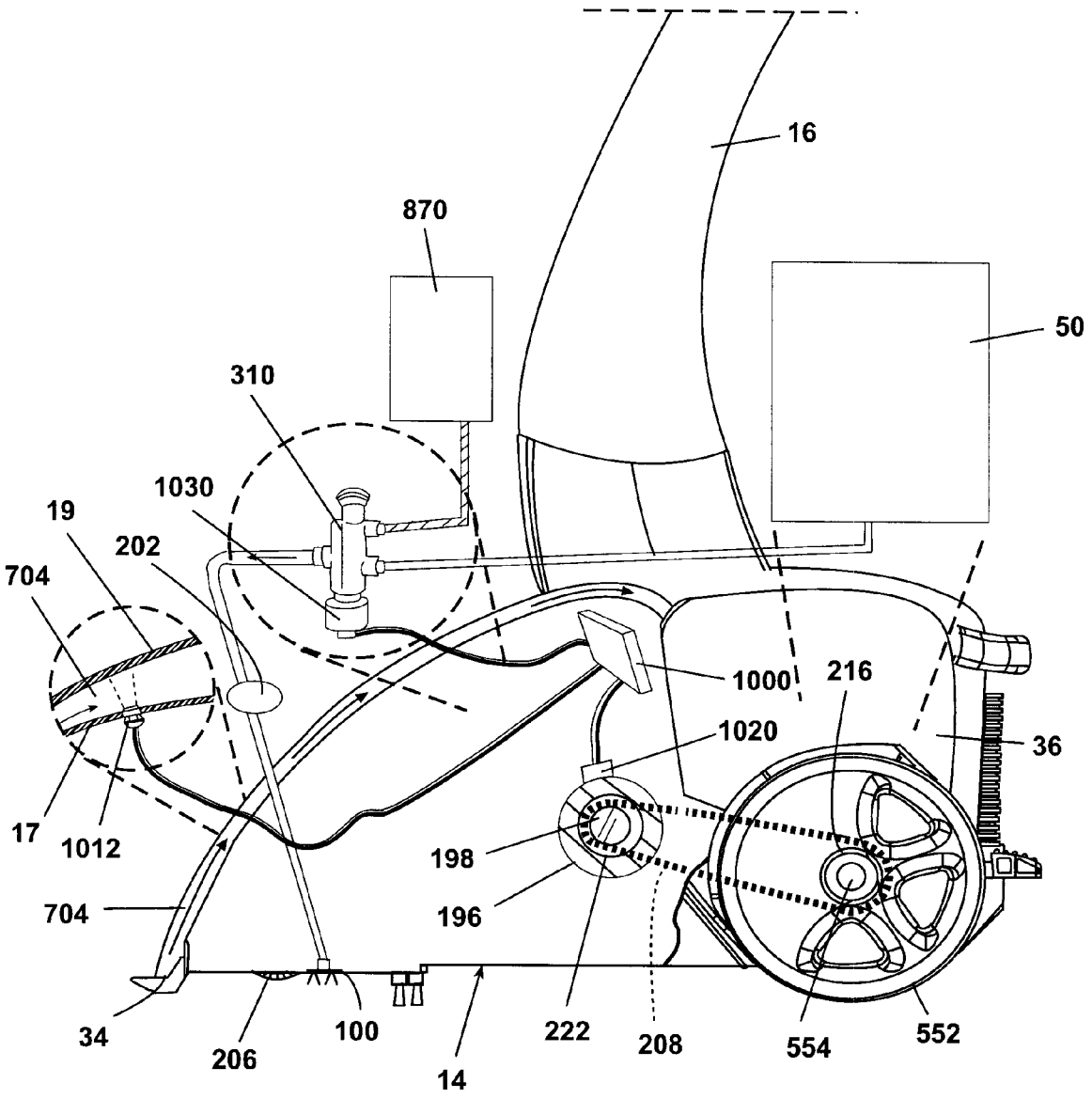
FIG. 3 is a diagrammatic side sectional view, like FIG. 1, of another embodiment of the base module of the extraction cleaning machine according to the invention.

Referring to FIG. 3, an alternative dirt sensor 1012 is a densitometer, photometer or other device for detecting characteristics of the dirty solution being extracted from the surface to be cleaned as it passes through working air conduit 704. A light source transmits radiation onto the recovered fluid in the working air conduit 704 and a sensor picks up the transmitted light. The transmitted light sensed in the working air conduit 704 is a measure of the dirt in the recovered solution passing through the working air conduit 704. In a like fashion to the analysis of the signal from a sensor directed at the surface being cleaned, the controller 1000 is programmed to compare the signal generated from the extracted fluid to data recorded in the controller for fluid extractions correlated to given soil levels in the surface being cleaned. The controller 1000 can also be programmed to respond to a change in the detected soil level as represented by a change in the intensity of the light transmitted to sensor 1012.

Additional alternative sensors 1012 for detecting characteristics of the dirty solution extracted from the surface being cleaned, are also anticipated. Such sensors can include an infrared sensor, a conductivity sensor, an image digitizer, spectral analysis of solution color, and a moisture sensor.

In an infrared sensor, a light emitting diode is a source of infrared radiation, and the sensor signal is generated by a photocell. The signal is based on the clarity of the extracted solution.

A conductivity sensor will generate a signal related to the conductivity of the extracted solution, which varies as the solids increase in the solution. This increase in conductivity can be compared to a zero standard, or to a known dirty extraction fluid standard, or can be compared to the conductivity of the cleaning solution that is being sprayed on the surface to be cleaned. The latter may be a preferred comparison, as differing water sources, due to water hardness and other factors might mandate use of the comparison in order to give a truer indication of the level of solids actually being extracted from the surface, rather than those already existing in the cleaning solution.

A digitized image of a water sample could be compared with images prepared for the purpose of establishing a standard for comparison, which can include spectral analysis of the image.

Figure 11:
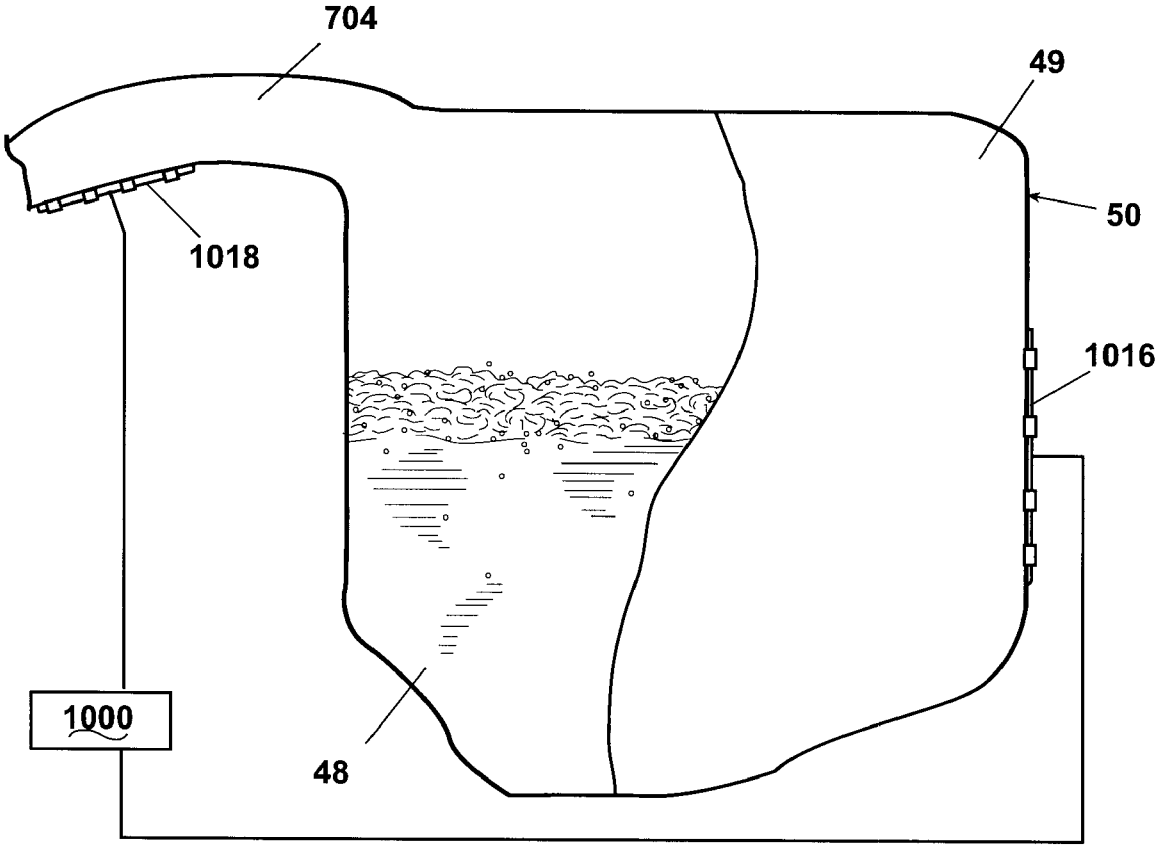
FIG. 11 is a diagrammatic side sectional view of the tank assembly of the extraction cleaner of FIGS 1–5.

Another measurement scenario for spectral analysis is to pass extracted solution in front of a standard background, where the color of the background is the same as the cleaning solution before application to the surface. As shown in FIG. 11, the color of the cleaning solution is reported to the controller 1000 by clean fluid color sensors 1016, and the color of the recovered solution is read by recovered fluid color sensors 1018 in working conduit 704. For example, if the extracted solution is the same color as the clean solution, the sensor will give a certain signal. If no solution is being extracted the same signal will be given. If the extracted solution does not match the background of the clean solution, the sensor can then give a comparative reading to the clean solution. A suggested light source in this situation is an incandescent reflected light source. An example of a spectral analyzer suitable for this purpose is manufactured by X-Rite, Inc. of Grandville, Mich.

Figure 6:
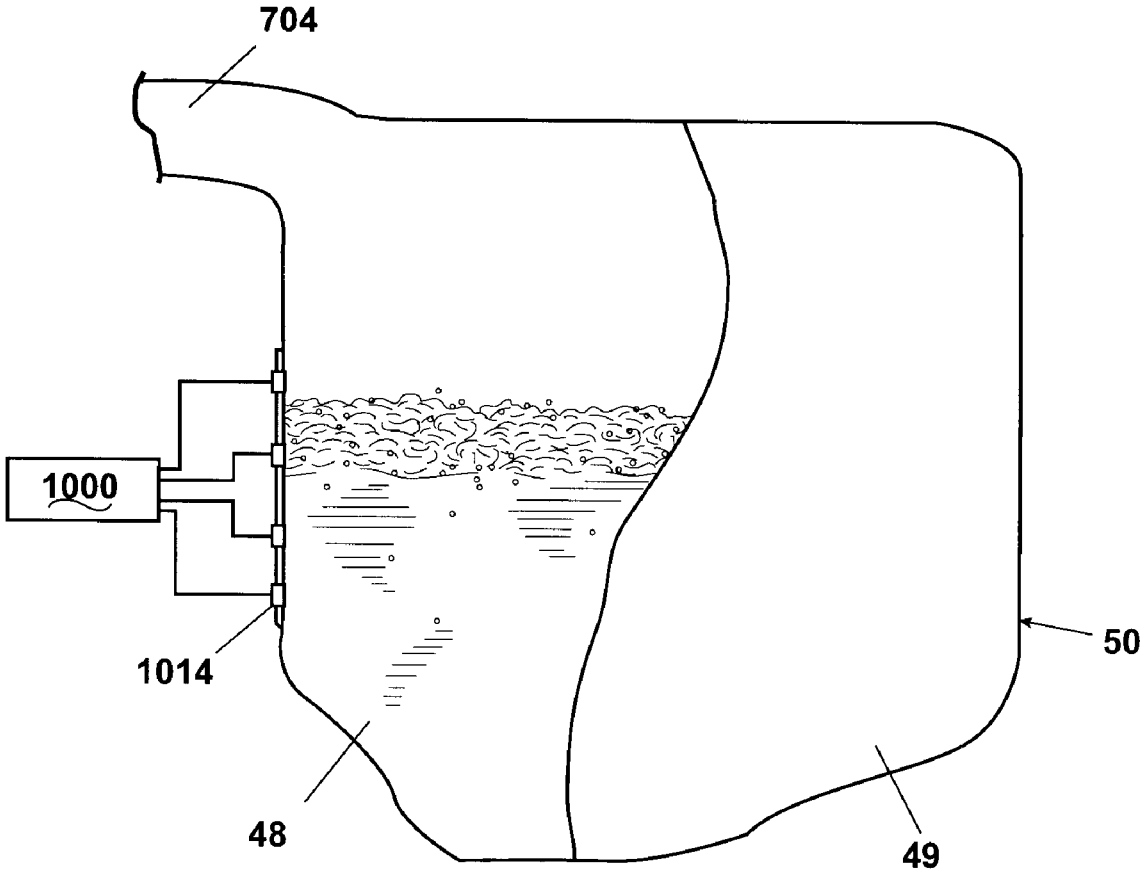
FIG. 6 is a diagrammatic side sectional view of the tank assembly of the extraction cleaner of FIGS. 1–5.

An additional method of measuring of the level of dirt that is being extracted is to measure the foam level in the extracted fluid in the recovery chamber 48, using sensor 1014, as illustrated in FIG. 6. The dirtier the water, the less foam will remain in the extracted fluid. Furthermore, there are other detectable properties of the extracted fluid, either measured against a standard or compared to the fluid that is being sprayed on the surface to be cleaned. These include the addition to the cleaning solution of chemical indicators that exhibit a color or other detectable property that is related to the amount of dirt in the water. This condition can be detected and used to control a variable cleaning control element to adjust the level of cleaning to the amount of dirt in the carpet or other surface.

A moisture sensor is useful in the context of the control of an extraction cleaning machine, in providing the controller 1000 an indication of the amount of solution remaining on the surface being cleaned. This information can be used, for example, to determine the speed of the vacuum motor, or the speed of the motor 196 in the reverse direction, for example.

The controller 1000 uses the sensor signal, and through it internal logic, determines an output signal for the speed controller 1020 and/or valve controller 1030. Controller 1000 can be switched to function in a mixing valve mode, a drive-motor mode, or both, or can be manually overridden by the operator to direct the mixing valve 310 and or motor 196 to function at a certain cleaning level. Thus, the upright extractor 12 can operate with only the speed controller 1020 responsive to the controller 1000, or in the alternative, the upright extractor 12 can operate with only the valve controller 1030 responsive to the controller 1000. For this condition, the rear wheels 552 can be powered by the motor 196 or unpowered. That is, the mixing valve 310 can be varied in response to the dirt level detected by the dirt sensor 1010 without regard to a powered drive for the extractor. Still further, the upright extractor 12 can operate with both a speed controller 1020 and a valve controller 1030, each individually responsive to the controller 1000. Of course, as mentioned above, the dirt sensor 1010 may detect the level of dirt in the recovered fluid in the working air conduit 704 or on the surface being cleaned.

When the upright extraction cleaner 12 includes a dirt sensor 1010, the speed of movement of the extraction cleaner and/or ratio of detergent to water is determined by the detected level of dirt in the surface to be cleaned, whether that detection occurs directly from the surface itself or from extracted fluid from that surface. The central processor of the controller 1000 stores reflection reference data to which it compares the measured reflection data. Preferably, controls are provided to the user to adjust the extent to which the carpet is cleaned, depending on the cleaning variation desired and relative effectiveness of the various predefined cleaning modes. The processor compares the reflection characteristics of the surface to the reference data to identify the level of dirt present on the surface being cleaned, then determines the corresponding cleaning mode for that soil condition, and applies control signals to the speed controller 1020 and/or valve controller 1030 for appropriate cleaning. That is, for each possible dirt level reading, the controller 1000 has predefined cleaning solution concentrations and cleaning speeds. Where both a speed controller 1020 and valve controller 1030 are connected to the controller 1000, the predefined cleaning solution concentrations and cleaning speeds are further coordinated such that the concentration is keyed to the speed, and vice versa, for any particular soil level. Thus, the cleaning variations are numerous and an optimal cleaning mode can be defined for relatively narrow ranges of differing soil levels.

The speed controller 1020 adjusts the forward speed to optimize the cleaning speed for the particular surface condition, from fast for relatively clean areas to slow for high-traffic areas. The dirt sensor 1010 preferably uses a reflectometer to measure color difference in the surface to be cleaned or turbidity of the fluid being extracted from the surface being cleaned. For example, the user can "teach" the extraction cleaner 12, via the controller 1000, what is clean and what is dirty by programming the extractor on clean and dirty surfaces, respectively. Or, the reflectometer or other photosensor can make continuous readings and learn as it cleans after a baseline reading is taken. After learning, the controller 1000 controls the extractor speed depending on the dirt sensor reading. The valve controller 1030 is preferably functionally related to the extractor speed. When the extractor slows for a high-traffic area, the valve controller adjusts the mixing valve 310 accordingly to increase the amount of cleaning solution in the cleaning mixture applied to the carpet or other surface to be cleaned.

Figure 7:
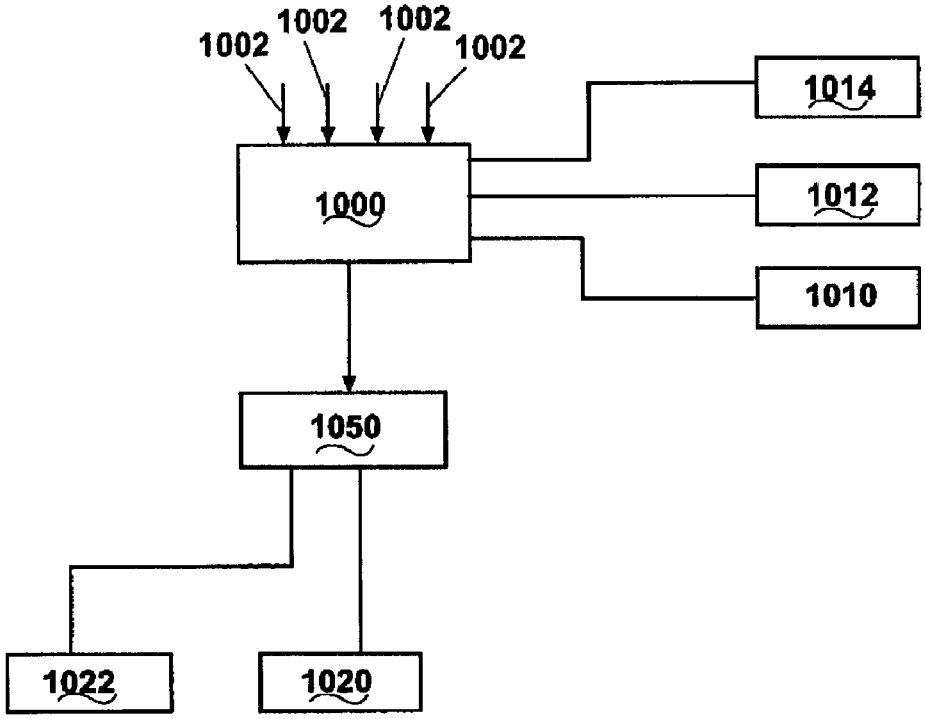
FIG. 7 is a schematic view of an alternative controller mode of the extraction cleaner according to the invention.
Figure 8:
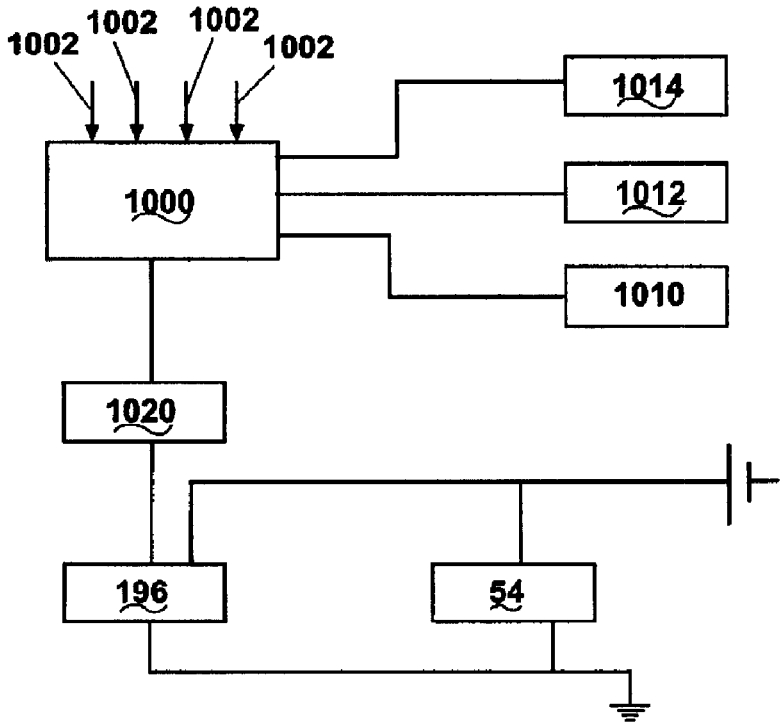
FIG. 8 is schematic view of an alternative controller mode of the extraction cleaner according to the invention.

A further embodiment of the invention includes the controller 1000 adjusting the power between the internal components of the extractor. Such power balancing develops more optimal cleaning characteristics in the extractor by balancing the power between the solution spray rate, the travel rate over the surface, the temperature control of the spray solution, and the extraction rate as developed by the suction source. The controller 1000 adjusts the power by controlling power distribution module 1050, as shown schematically in FIG. 7. The distribution of power between internal elements of the cleaner can also be accomplished by using a switched reluctance motor, referring to FIG. 8, which will vary the motor speed in concert with the heater wattage so that while the suction is reduced, the heat is boosted in the sprayed fluid, and suction is slowed down to enhance cleaning by providing additional soak time using the higher temperature cleaning solution.

Another variation in controlling the application and removal of the cleaning solution is an automatic pre-treat setting where the suction airflow is cut off in extra dirty areas or high traffic areas during a pre-treatment pass of the spraying solution, again to allow additional time for the pre-treatment to work on the dirt in the carpet.

In a further embodiment, the controller 1000 is programmed to increase the power to the vacuum source, i.e. a burst of power, in high traffic areas, or especially dirty areas, to increase the suction force for a short period to increase the suction applied to the given dirty area. This response by the controller 1000 is in response to an operator or sensor signal, shown in FIG. 5 as another controller input 1002, wherein the operator or a sensor indicates to the controller an area on the surface being cleaned that requires concentrated cleaning. Controller inputs 1002 also signify input of other operator or sensor signals for use by controller 1000.

Figure 9:
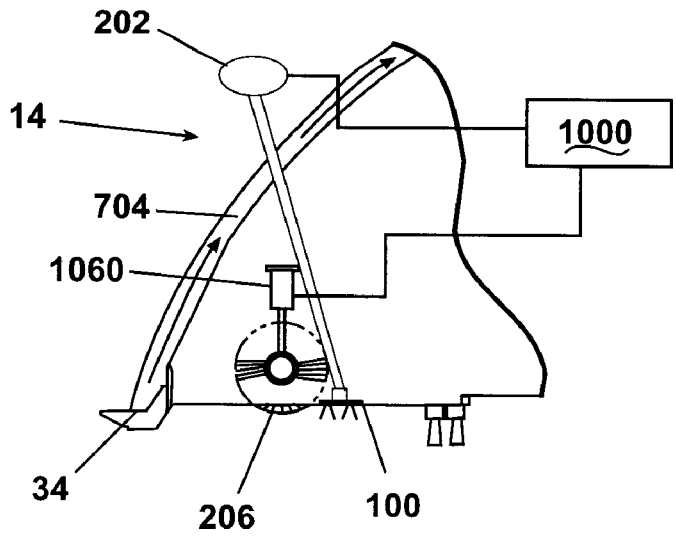
FIG. 9 is a diagrammatic side sectional view of the extraction cleaner of FIGS. 1–5 with a controlled, adjustable agitation brush.

In a further embodiment, the pressure or speed of the agitation brush can be varied. The agitation brush of an extraction cleaner can be driven at varying speeds determined by the motor powering the agitation brush. To vary the pressure exerted by the agitation brush on the surface to be cleaned, the brush can be pressed against the surface being cleaned by releasing the brush under the force of gravity, or by the inclusion of an actuator, such as a solenoid 1060 as shown in FIG. 9, to positively press the brush down against the surface being cleaned.

Figure 10:
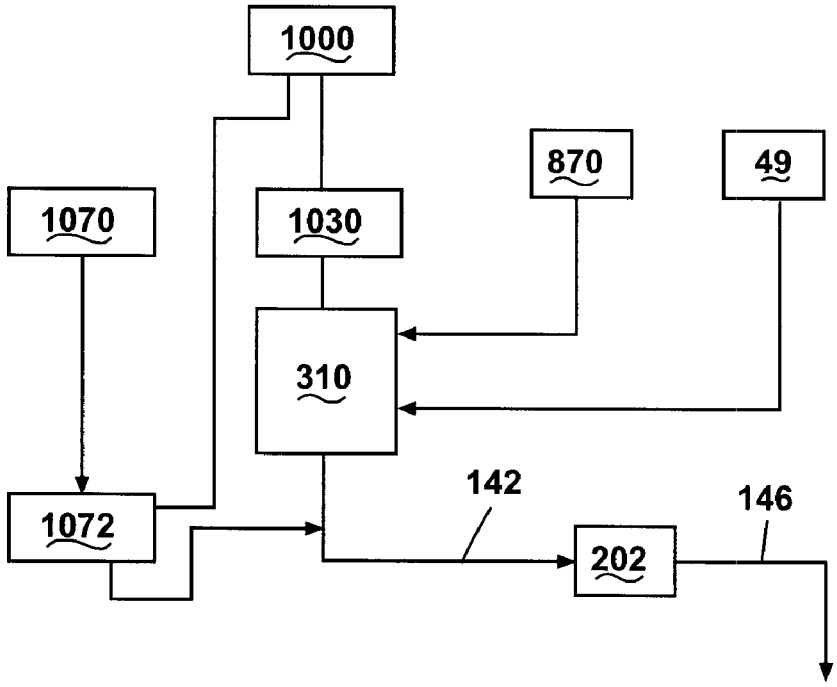
FIG. 10 is a schematic view of a portion of the fluid application system of FIG. 5 according to another embodiment of the invention.

As shown schematically in FIG. 10, the extraction cleaner can further include additional supply tanks 1070 for holding additives to the cleaning solution, such as an oxidizer or booster. The additive is released into the cleaning solution at the intake to pump 202 by a release valve 1072, which can be actuated either by the controller 1000 or manually by the operator.

Another method of providing additional cleaning power to the surface to be cleaned is a burst of steam, which can be sensor controlled or manually activated by the operator. The water supplied to the heater is reduced or the power to the heater can be increased, which transfers more energy to the water available to the heater, thereby producing a burst of steam. This steam added to the cleaning process can be in a burst of steam or can be a steam "pass" as part of a recommended series of passes during use of the extractor. In the alternative, the extractor can be configured to include a separate steam function whereby all of the available power of the extractor is diverted to the solution-heating element to provide maximum steam flow.

Figure 4:
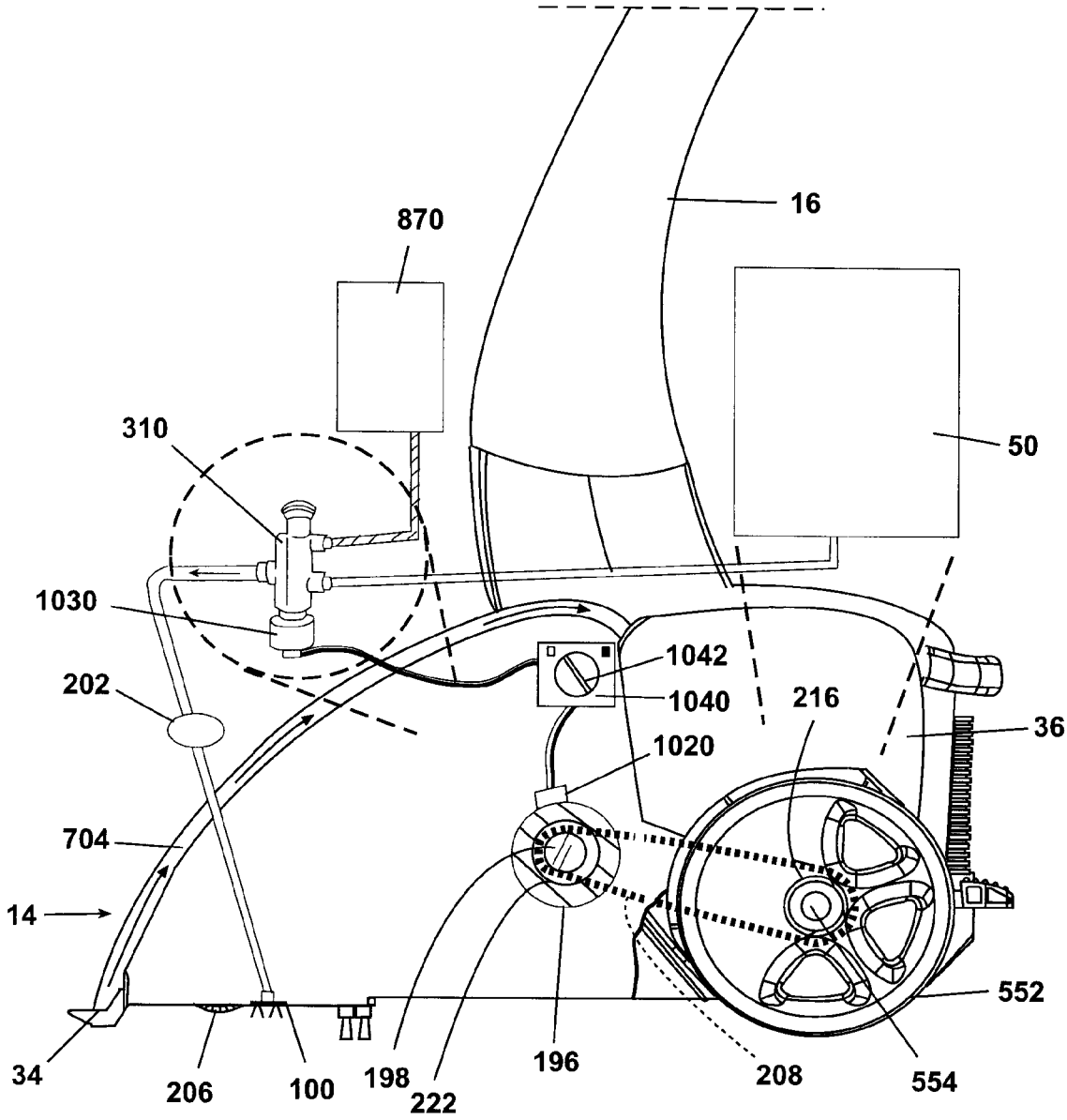
FIG. 4 is a diagrammatic side sectional view, like FIG. 1, of a further embodiment of the base module for the extraction cleaning machine according to the invention.

In the embodiment illustrated in FIG. 4, the upright extractor 12 can operate without a dirt sensor, but the speed controller 1020 and valve controller 1030 are responsive to signals from the controller 1040 which is set by the user according to user preference for the level of cleaning. That is, if the user desires a heavy cleaning, moving an actuator knob 1042 on the controller 1040 to a position for heavy cleaning signals the valve controller 1030 to permit a high ratio of detergent to water and signals the speed controller 1020 to slow movement of the extractor to permit thorough agitation and suction of the applied cleaning solution. Similarly, moving the actuator knob 1042 to a lighter cleaning level reduces the concentration of cleaning solution applied at a relatively faster speed.

As shown in FIGS. 2–4, the base module 14 houses drive motor 196 that is connected to a source of electricity by the electrical cord. A motor compartment (not shown) within the base module 14 securely mounts motor 196 in place. While the motor 196 as shown drives only rear wheels 552, the motor 196 can also drive the agitation brush (not shown) as well as an impeller fan (not shown) for creating a vacuum source for drawing dirt, debris and fluid from the surface being cleaned.

The motor 196 includes a motor drive shaft 198, which includes drive belt 208 thereon for driving the rear wheels 552. Preferably, on the opposite side of the motor 196, the motor drive shaft 198 supports the impeller within an impeller housing. With this configuration, a single drive motor 196 is adapted to provide driving force for the impeller and the rear wheels 552. Alternatively, the motor 196 can be used to drive only the rear wheels 552. Alternatively, the motor 196 can drive the rear wheels 552, the impeller, and fluid pump 202 for providing cleaning solution to spray nozzles 100. Preferably, a clutch (not shown) is provided between the motor 196 and the rear wheels 552 and controlled by a spring biased lever to drive the wheels in a forward direction and to release the drive in a rear direction. Separate motors can be provided for driving the rear wheels 552, the pump, the agitator and the impeller, if desired.

As best shown in FIGS. 2–4, the drive belt 208 is reeved through a pulley 216 mounted on a wheel axle 554 for the rear wheels 552 and a pulley 222 on the drive shaft 198 of the motor 196. Preferably, the pulleys 216, 222 have toothed perimeters adapted for registration with the teeth in the drive belt 208.

Referring again to FIGS. 2–4, after the cleaning solution has been applied to the surface to be cleaned via the spray nozzles 100, the used cleaning solution and entrapped dirt are removed from the surface being cleaned through the suction nozzle 34, which opens into working air conduit 704. The working air conduit 704 terminates in the tank assembly 50, and more particularly in the recovery chamber 48 therein that fluidly isolates the dirty solution from the clean water.

In one embodiment of the invention, the extractor is driven at the optimal rate for cleaning the carpet to reach a predetermined standard. In addition to or in lieu of driving the extractor at an optimal speed, the spray and suction rates are adjusted to optimize the cleaning action of the extractor based on the sensed soil levels in the surface to be cleaned. However, in an extractor where the speed is not controlled by the sensors, or in an extractor that is not self-propelled, it would be advantageous in certain circumstances to provide feedback to the user to enable the user to manually control the speed or other variable control element of the extractor. The feedback provided to the user can take the form of an audible signal, having a differentiation between traveling too fast versus traveling too slow, or a visual signal, such as a speedometer giving the speed of the extractor across the carpet or other surface being cleanes. An anticipated visual signal would be, for example, a light bar that would give an indication to the user on a scale showing the actual speed of the extractor compared to the optimal speed on the scale for a particular level of soil in the carpet or other surface being cleanes. This comparison between the actual speed of the extractor, as powered manually by the user, and the optimal speed of the extractor, can be based on a pre-programmed speed as determined by experimentation or can be determined by an electronic controller upon evaluation of the effectiveness of cleaning of the extractor in response to the sensor signals provided to the controller and previously discussed. The pre-programmed optimal speed can be available in different levels or modes, such as for normal cleaning or high traffic areas. Alternatively, the signal from the controller 1000 can be a signal representative of the amount of dirt in the carpet. The operator can manually override the controller to adjust the amount of cleaning by the extractor by manually adjusting any of the manual controls of the extractor or by providing specific inputs to the controller 1000 through inputs 1002 shown in FIG. 5. Alternatively, as shown in FIG. 5, a manual override input 1028 can be provided on the speed controller 1020 to manually set a level of speed for the extractor based on the amount of dirt sensed by the sensor 1010. The same type of override control can be provided on any of the variable control elements on the extractor.

As further illustrated in FIG. 5, the controller 1000 is connected to a visual display device 1024 and is adapted to apply to the visual display device 1024 a signal which is converted in the visual display device 1024 to a digital or analog reading on a screen or meter in the visual display device 1024 to indicate the level of dirt in the carpet. As further shown in FIG. 5, the visual display device 1024 can include an speaker 1026, which delivers an audible signal responsive to a signal from the controller 1000.

While particular embodiments of the invention have been shown, it is understood, of course, that the invention is not limited thereto since modifications may be made by those skilled in the art, particularly in light of the foregoing teachings. Reasonable variation is possible within the scope of the foregoing disclosure of the invention without departing from the spirit of the invention.

What is claimed is:

1. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying liquid to the surface to be cleaned;

a fluid supply chamber for holding a supply of cleaning fluid;

a fluid supply conduit fluidly connected to the fluid supply chamber and to the dispensing nozzle for supplying fluid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

a variable cleaning control element mounted on the housing and adjustable to control the rate of cleaning by the extraction surface cleaning apparatus;

the improvement comprising:

a sensor mounted to the housing for detecting a condition of the surface to be cleaned and for generating a condition signal representative of the detected condition of the surface to be cleaned.

2. The extraction surface cleaning apparatus of claim 1 and further comprising a controller operably coupled to the sensor and to the variable cleaning control element, the controller being programmed to control the variable cleaning control element in accordance with the detected condition of the surface to be cleaned.

3. The extraction surface cleaning apparatus of claim 2 wherein the detected condition is related to the degree of soil in the surface to be cleaned and the condition signal is a soil-degree signal and wherein the controller includes a data structure having data representative of various degrees of soil in the surface and control settings on the variable cleaning control element; and the controller is further programmed to compare the soil degree signal with the data representative of various degrees of soil in the surface to be cleaned and for generating a control signal to the variable cleaning control element to adjust the degree of cleaning of the extraction surface cleaning apparatus to match the detected degree of soil in the surface to be cleaned.

4. The extraction surface cleaning apparatus of claim 2 wherein the variable cleaning control element is a variable speed motor operably connected to the wheels for driving the wheels and powering the housing along the surface to be cleaned, the motor including a speed control component for controlling the speed of the motor and thus the rotational speed of the wheels.

5. The extraction surface cleaning apparatus of claim 2 wherein the fluid supply chamber comprises a first tank for concentrated cleaning solution, a second tank for water, a mixing valve for adjusting the relative amounts of concentrated cleaning solution and water, and conduits connecting the first with second tanks and the mixing valve, and wherein the variable cleaning control element is the mixing valve.

6. The extraction surface cleaning apparatus of claim 2 and further comprising a motor operably connected to the wheels for driving the wheels and powering the housing along the surface to be cleaned, and wherein the variable cleaning control element is a speed control component for controlling the rotational speed of the wheels.

7. The extraction surface cleaning apparatus of claim 1 wherein the detected condition is related to the degree of soil in the surface to be cleaned and the condition signal is a soil-degree signal.

8. The extraction surface cleaning apparatus of claim 7 wherein the sensor detects the soil degree condition by measuring a characteristic of the surface to be cleaned.

9. The extraction surface cleaning apparatus of claim 7 wherein the sensor detects the soil degree condition by measuring a property of the recovered fluid.

10. The extraction surface cleaning apparatus of claim 9 wherein the property of the recovered fluid is the relative degree of dirt in the recovered fluid.

11. The extraction surface cleaning apparatus of claim 10 wherein the sensor is positioned adjacent the working air conduit to detect the degree of dirt in the working air conduit.

12. The extraction surface cleaning apparatus of claim 10 wherein the sensor is positioned in or adjacent to the recovery chamber to detect the relative amounts of foam in the recovery chamber created during the drawing of the liquid into the recovery chamber.

13. The extraction surface cleaning apparatus of claim 10 wherein the sensor comprises a photocell and the property of the recovered fluid is its light intensity value.

14. The extraction surface cleaning apparatus of claim 13 wherein the sensor further comprises a light source.

15. The extraction surface cleaning apparatus of claim 10 wherein the sensor comprises a conductivity sensor.

16. The extraction surface cleaning apparatus of claim 10 and further comprising:

a controller operably coupled to the sensor and to the variable cleaning control element to control the variable cleaning control element in accordance with the detected condition of the surface to be cleaned;

the controller includes a data structure having data representative of various degrees of soil in the surface and control settings on the variable cleaning control element; and wherein the data structure includes data representative of the light intensity value of the cleaning fluid and the controller includes a spectral comparator for comparing the light intensity value of the recovered fluid to the light intensity value of the cleaning fluid.

17. The extraction surface cleaning apparatus of claim 16 wherein the sensor is positioned to detect the color of the cleaning fluid in the fluid supply conduit and connected to the controller to form the data representative of the color of the cleaning fluid.

18. The extraction surface cleaning apparatus of claim 16 wherein the data representative of the cleaning fluid is a predetermined value.

19. The extraction surface cleaning apparatus of claim 9 wherein the condition is the concentration of a chemical component of the recovered fluid.

20. The extraction surface cleaning apparatus of claim 19 wherein the chemical component is a compound in the cleaning fluid that is modified by the soil level in the recovered fluid.

21. The extraction surface cleaning apparatus of claim 7 wherein the sensor comprises a reflectance sensor directed at the surface being cleaned to sense the degree of soil in the surface.

22. The extraction surface cleaning apparatus of claim 7 and further comprising an indicator coupled to the sensor to indicate to an operator the detected condition of the degree of soil in the surface to be cleaned.

23. The extraction surface cleaning apparatus of claim 7 and further comprising a controller operably coupled to the sensor and to the variable cleaning control element, the controller having a memory with a first stored reference value representative of a desired clean floor condition and the controller is further programmed to compare the soil degree signal with the first stored reference value and for generating a control signal to the variable cleaning control elements until the soil degree signal is within a predetermined threshold of the first stored reference value.

24. The extraction surface cleaning apparatus of claim 23 wherein the controller has a learning mode, an active mode and a manual switch for converting the controller from the learning mode to the active mode and vice versa; the controller is programmed so that the soil degree signal is the first reference value when the controller is in the learning mode, and, when the controller is in the active mode, the soil degree signal is compared with the first reference value to control the variable cleaning control element in accordance with the detected condition of the surface to be cleaned, whereby a user can place the controller in the learning mode via the manual switch and operate the apparatus over a clean floor surface to set the first reference value, and then actuate the manual switch to the active mode and operate the extraction surface cleaning apparatus on a dirty floor surface.

25. The extraction surface cleaning apparatus of claim 1 wherein the sensor comprises a moisture sensor and is positioned to detect the level of moisture in the surface to be cleaned.

26. The extraction surface cleaning apparatus of claim 1 and further comprising an in-line heater in the fluid supply conduit for heating the cleaning fluid, and a variable electrical supply to the in-line heater; wherein the variable cleaning control element comprises the variable electrical supply.

27. The extraction surface cleaning apparatus of claim 1 and further comprising a variable-flow fluid pump in the fluid supply conduit and wherein the variable cleaning control element comprises the variable-flow fluid pump.

28. The extraction surface cleaning apparatus of claim 1 wherein the vacuum source includes a variable-speed motor and the variable cleaning control element comprises the variable-speed motor to vary the flow of working air from suction nuzzle.

29. The extraction surface cleaning apparatus of claim 1 and further comprising an agitator for agitating the surface to be cleaned and a height-adjustment mechanism for mounting the agitator to the housing at various heights with respect to the surface to be cleaned and wherein the variable cleaning control element comprises the height-adjustment mechanism.

30. The extraction surface cleaning apparatus of claim 29 and further comprising a variable pressure application mechanism for applying a variable degree of pressure to the agitator and wherein the variable cleaning control element comprises the variable pressure application mechanism.

31. The extraction surface cleaning apparatus of claim 29 and further comprising a variable-speed motor driving the agitator and wherein the variable cleaning control element comprise the variable-speed motor.

32. The extraction surface cleaning apparatus of claim 1 and further comprising an agitator for agitating the surface to be cleaned; a variable-speed motor driving the agitator and wherein the variable cleaning control element comprises the variable-speed motor.

33. The extraction surface cleaning apparatus of claim 1 and further comprising at least one booster tank for holding at least one of a booster and oxidizing agent, a mixing valve for adjusting the relative amounts of booster or oxidizing agent and cleaning solution and conduits between the booster tank and fluid supply tank and mixing valve, and wherein the variable cleaning control element is the mixing valve.

34. The extraction surface cleaning apparatus of claim 1 wherein there are multiple variable cleaning control elements mounted on the housing and adjustable to control the degree of cleaning by the extraction surface cleaning apparatus, and further comprising a controller which is programmed to control each of the multiple variable cleaning control elements either singularly or multiply.

35. The extraction surface cleaning apparatus of claim 34 wherein the controller further comprises manual controls for at least some of the multiple cleaning control elements for manual selection or control of one or more of the cleaning control elements.

36. The extraction surface cleaning apparatus of claim 35 wherein the liquid dispensing system further includes a heater to heat the cleaning fluid to steam whereby steam is sprayed onto the surface to be cleaned, the fluid supply chamber comprises a first tank for concentrated cleaning solution, a second tank for water, a mixing valve for adjusting the relative amounts of concentrated cleaning solution and water, and conduits connecting the first and second tanks with the mixing valve, a motor operably connected to the wheels for driving the wheels and powering the housing along the surface to be cleaned, the vacuum source includes a variable-speed motor, an agitator for agitating the surface to be cleaned and at least one of a height-adjustment mechanism for mounting the agitator to the housing at various heights with respect to the surface to be cleaned, a variable pressure application mechanism for applying a variable degree of pressure to the agitator, and a variable-speed motor driving the agitator, and wherein the multiple cleaning control elements include at least one of the amount of steam generated by the heater, the relative position of the mixing valve, the speed of the housing along the surface to be cleaned, the power to the vacuum source variable-speed motor and pressure, height or speed of the agitator.

37. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying liquid to a surface to be cleaned;

a fluid supply chamber for holding a supply of cleaning fluid;

a fluid supply conduit fluidly connected to the fluid supply chamber and to the dispensing nozzle for supplying liquid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

a variable cleaning control element mounted on the housing and adjustable to control the degree of cleaning by the extraction surface cleaning apparatus;

the improvement comprising:

a sensor mounted to the housing for detecting a condition relative to the degree of soil in the surface to be cleaned and adapted to generate a soil-degree signal representative of the detected condition of the relative degree of soil in the surface to be cleaned; and an audible or visual indicator coupled to the sensor and adapted to indicate the relative degree of soil in the surface to be cleaned; and a manual control for varying the cleaning control element by the operator.

38. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying liquid to a surface to be cleaned;

a fluid supply chamber for holding a supply of cleaning fluid;

a fluid supply conduit fluidly connected to the fluid supply chamber and to the dispensing nozzle for supplying liquid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

a variable cleaning control element mounted on the housing and adjustable to select the degree of cleaning by the extraction surface cleaning apparatus;

the improvement comprising:

a sensor mounted to the housing for detecting a condition relative to the degree of cleaning by the extraction surface cleaning apparatus; and an audible or visual indicator coupled to the sensor and adapted to indicate the condition relative to the sensed degree of cleaning by the extraction surface cleaning apparatus.

39. The extraction surface cleaning apparatus of claim 38 wherein the condition relative to the degree of cleaning is the speed of the housing over the surface to be cleaned.

40. The extraction surface cleaning apparatus of claim 38 wherein the condition relative to the degree of cleaning is a property of the recovered fluid.

41. An extraction surface cleaning apparatus having:

a housing;

at least two wheels mounted to the housing for supporting the housing for movement along a surface to be cleaned;

a liquid dispensing system mounted to the housing and including:

a liquid dispensing nozzle for applying liquid to a surface to be cleaned;

a fluid supply chamber for holding a supply of cleaning fluid;

a fluid supply conduit fluidly connected to the fluid supply chamber and to the dispensing nozzle for supplying liquid to the dispensing nozzle;

a fluid recovery system mounted to the housing and including:

a recovery chamber for holding recovered fluid, a suction nozzle, a working air conduit extending between the recovery chamber and the suction nozzle; and a vacuum source in fluid communication with the recovery chamber for generating a flow of working air from the suction nozzle through the working air conduit and through the recovery chamber to thereby draw dirty liquid from the surface to be cleaned through the suction nozzle and the working air conduit, and into the recovery chamber;

the improvement comprising:

a sensor mounted to the housing for detecting a condition relative to the level of moisture in the surface being cleaned and adapted to generate a moisture level signal representative of the detected condition of the relative degree of moisture in the surface being cleaned; and an audible or visual indicator coupled to the sensor and adapted to indicate the relative moisture level in the surface being cleaned.

* * * * *

UNITED STATES PATENT AND TRADEMARK OFFICE

CERTIFICATE OF CORRECTION

PATENT NO. : 6,446,302 B1
DATED : September 10, 2002
INVENTOR(S) : Gary A. Kasper et al.

It is certified that error appears in the above-identified patent and that said Letters Patent is hereby corrected as shown below:

Column 14,
Line 49, "first with second" should be -- first and second --.
Line 49, "tanks and the" should be -- tanks with the --.

Column 15,
Line 12, insert -- dirty -- before "liquid".

Signed and Sealed this

Twelfth Day of November, 2002

*Attest:*

*Attesting Officer*

JAMES E. ROGAN
*Director of the United States Patent and Trademark Office*